United States Patent [19]

Abthoff et al.

[11] Patent Number: 4,852,349

[45] Date of Patent: Aug. 1, 1989

[54] ARRANGEMENT FOR THE REMOVAL OF SOOT PARTICLES FROM THE EXHAUST GAS STREAM OF A DIESEL INTERNAL COMBUSTION ENGINE

[75] Inventors: Joerb Abthoff, Pluederhausen; Hans-Dieter Schuster, Schorndorf; Hans-Joachim Langer, Remseck; Erwin Strohmer, Berglen; Rolf Gabler, Waiblingen; Roland Schulte, Korb, all of Fed. Rep. of Germany

[73] Assignee: Daimler-Benz Aktiengesellschaft, Stuttgart, Fed. Rep. of Germany

[21] Appl. No.: 176,153

[22] Filed: Mar. 31, 1988

[30] Foreign Application Priority Data

Apr. 3, 1987 [DE] Fed. Rep. of Germany ..... 3711311

[51] Int. Cl.[4] ..... F01N 3/02

[52] U.S. Cl. ..... 60/303; 55/466; 55/DIG. 30; 60/311

[58] Field of Search ..... 60/303, 311; 55/466, 55/DIG. 30

[56] References Cited

U.S. PATENT DOCUMENTS

| | | | |
|---|---|---|---|
| 4,283,207 | 8/1981 | Martiniuk | 60/311 |
| 4,455,823 | 6/1984 | Bly | 60/311 |

FOREIGN PATENT DOCUMENTS

| | | |
|---|---|---|
| 0152623 | 12/1984 | European Pat. Off. . |
| 3341177 | 4/1984 | Fed. Rep. of Germany . |
| 3504299 | 8/1986 | Fed. Rep. of Germany . |
| 3019991 | 12/1987 | Fed. Rep. of Germany . |
| 57-163111 | 3/1981 | Japan . |
| 57-163112 | 3/1981 | Japan . |
| 59-145314 | 2/1983 | Japan . |

*Primary Examiner*—Douglas Hart
*Attorney, Agent, or Firm*—Barnes & Thornburg

[57] ABSTRACT

An arrangement for removing soot particles from the exhaust stream of a diesel internal combustion engine in such a manner that the soot particles are caught between conductor elements disposed at different potential, produce a short circuit and thereby burn off. In order to be able to realize a purification of the exhaust gas stream without a significant increase of the exhaust gas counterpressure, a centrifugal separator is connected to the exhaust gas line, which passes over into a soot particle collecting chamber constructed axially symmetrical to the longitudinal axis thereof; a predetermined number of electrodes is arranged in turn in the soot particle collecting chamber at a slight distance to the casing interior surface whereby the electrodes among one another or the electrodes and the soot particle collecting chamber itself are at a different potential.

11 Claims, 2 Drawing Sheets

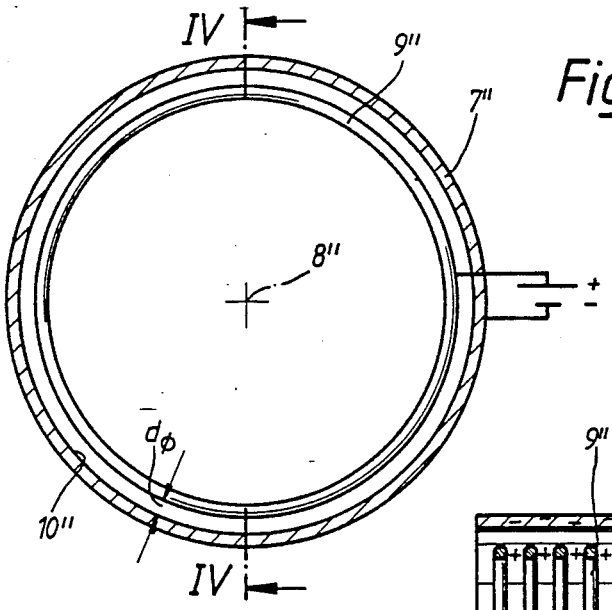
Fig. 3
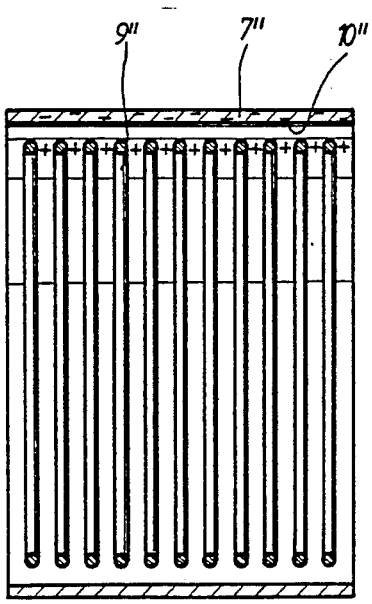
Fig. 4
Fig. 5
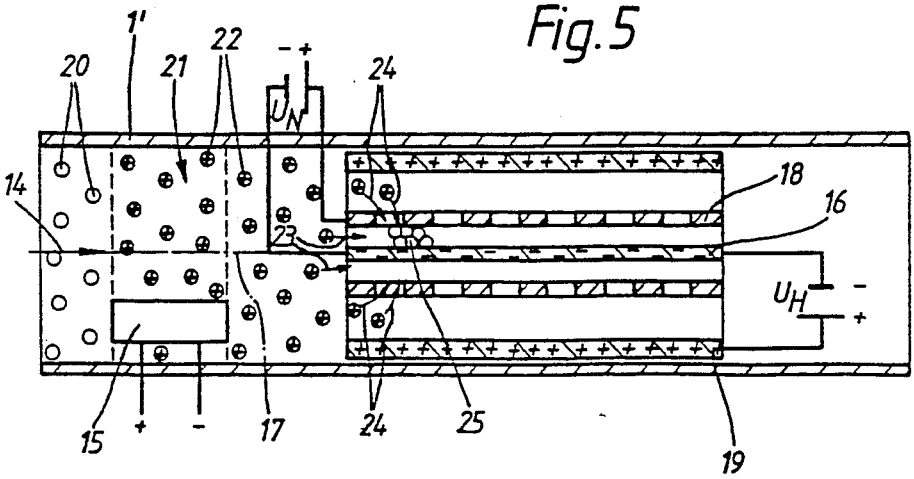

ARRANGEMENT FOR THE REMOVAL OF SOOT PARTICLES FROM THE EXHAUST GAS STREAM OF A DIESEL INTERNAL COMBUSTION ENGINE

BACKGROUND AND SUMMARY OF THE INVENTION

The present invention relates to an arrangement for the removal of soot particles from the exhaust gas stream of a diesel internal combustion engine with a soot particle collecting section arranged in the exhaust gas line, in which conductor elements are arranged that are at a different potential for catching the soot particles.

In an arrangement of the aforementioned type, disclosed in the Japanese Patent No. 57-16311, the soot particle collecting section consists of a combination of several conductor plates disposed at different potential between which is provided a granulate for catching the soot particles. However, as the soot particle collecting section must extend over the entire cross section of the exhaust gas flow, it represents a relatively large flow resistance that causes a high exhaust gas counterpressure.

Furthermore, it is known from the EP-A No. 15 26 23 to catch the soot particles of an exhaust gas stream in a soot particle chamber connected to a centrifugal separator and to conduct the purified exhaust gas stream into the atmosphere on the opposite side.

The present invention is concerned with the task to provide an arrangement of the type described above, by means of which a soot particle removal from the exhaust gas stream is realizable in a simple manner and without significant increase of the exhaust gas counterpressure.

The underlying problems are solved according to the present invention in that a centrifugal separator is connected to the exhaust gas line, in that the soot particle collecting section is a soot particle collecting chamber disposed on the downstream side of the centrifugal separator connected with the same and constructed axially symmetrical with respect to the longitudinal axis thereof, in that a predetermined number of electrodes is arranged at a slight distance from the casing interior surface of the soot particle collecting chamber and in that the electrodes are at a different potential among one another or the electrodes and soot particle collecting chamber itself are at a different potential. In the alternative, the underlying problems are solved according to the present invention in that a device for the ionization of soot particles that flow past the same, is provided in the exhaust gas line upstream of the soot particle collecting section, in that an electrostatically charged first electrode is arranged in the soot particle collecting section within the area of the longitudinal center axis thereof, in that the first electrode is surrounded by an oppositely electrically charged counter-electrode that is arranged in direct proximity of the wall of the exhaust gas line, in that a burning-off electrode permeable to soot particles is placed at a small distance in front of the first electrode or the counter-electrode, in that a low voltage is applied between the electrode which has the burning-off electrode placed in front of it, and the burning-off electrode itself, and in that the ionized soot particles and the electrode which has the burning-off electrode placed in front of it, possess an opposite charge.

It is assured with the arrangements according to the present invention that a maximum proportion in soot particles is burned off in a simple manner by short-circuiting two electrical conductors while at the same time a significant impairment of the exhaust gas flow carrying along the soot particles does not exist. According to another feature of the present invention, the electrodes are arranged over the circumference of a soot particle collecting chamber connected to a centrifugal separator of known type (cyclone separator) and thus form no flow obstacle disposed directly in the exhaust gas flow.

If, according to still another feature of the present invention, the electrodes are bent angularly toward the interior of the soot particle collecting chamber on their side facing the flow of the soot particles, one obtains additionally the advantage that soot particles are also collected which move on a circular path somewhat further away from the casing interior surface of the soot particle collecting chamber.

According to a further feature of the present invention, a predetermined number of electrodes inclined toward the interior of the soot particle collecting chamber is arranged distributed over the interior circumference of the soot particle collecting chamber whereby the spacing of the electrodes with respect to the casing interior surface of the soot particle collecting chamber is greater on their side facing the flow of the soot particles than on the opposite side. This arrangement of the electrodes enables a burning off of a greater number of previously collected soot particles.

Even though according to another embodiment of the present invention the individual electrodes are located in the exhaust gas stream, the end face of the electrodes which effectively face the flow of the exhaust gases is very small in comparison to the overall exhaust gas line cross section. In order that the individual soot particles are nonetheless conducted between the electrodes causing their burning-off, a correspondingly built up electric field is provided which deflects the previously ionized soot particles in the direction of the electrodes partaking in the burning off of the soot particles.

Even if as a result of a trouble in the current supply of the burning-off electrodes, a burning off of the soot particles is prevented, the exhaust gases together with soot particles can still flow off into the atmosphere without having to overcome greater flow resistances. A closing of the exhaust gas line by a clogging-up exhaust gas line and therewith necessarily a stoppage of the internal combustion engine as a result of an excessively high exhaust gas counterpressure is therewith precluded in accordance with the present invention.

BRIEF DESCRIPTION OF THE DRAWINGS

These and other objects, features and advantages of the present invention will become more apparent from the following description when taken in connection with the accompanying drawing which shows, for purposes of illustration only, four embodiments in accordance with the present invention, and wherein:

FIG. 3 is a cross-sectional view through a third embodiment of a soot particle collecting chamber in accordance with the present invention;

FIG. 4 is a cross-sectional view taken along line IV—IV of FIG. 3; and

FIG. 5 is a longitudinal cross-sectional view through still another embodiment of an exhaust gas line in accordance with the present invention.

DETAILED DESCRIPTION OF THE DRAWINGS

Figure 1:
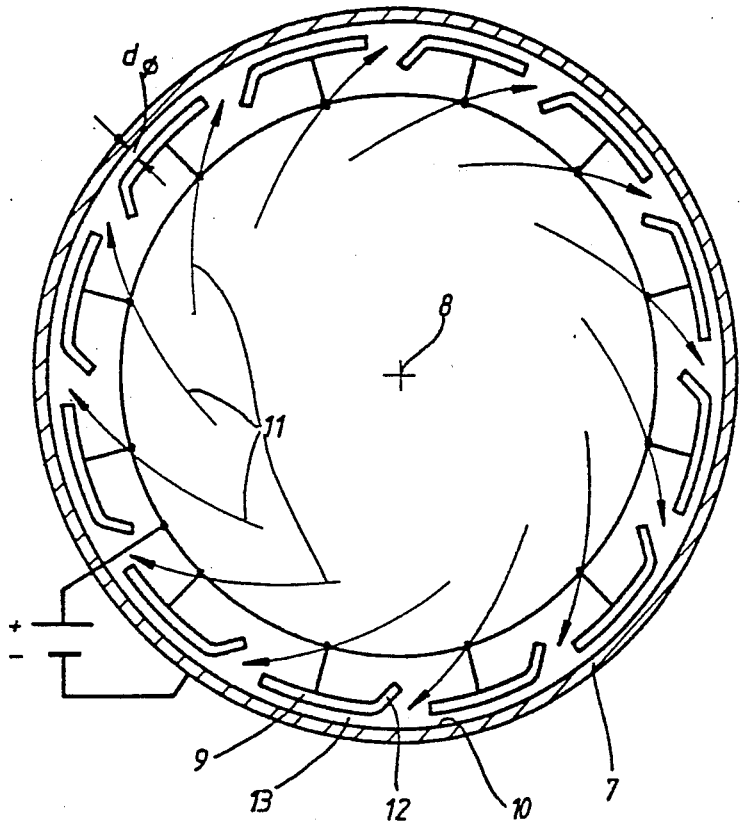
FIG. 1 is a cross-sectional view through one embodiment of a soot particle collecting chamber in accordance with the present invention.

Referring now to the drawing wherein like reference numerals are used throughout the various views to designate like parts, and more particularly to FIG. 1, this figure illustrates a cross section through a cylindrical soot particle collecting chamber 7, with respect to which a centrifugal separator of customary construction (cyclone separator) is series-connected upstream thereof and more particularly in such a manner that the cylinder longitudinal axis 8 of the collecting chamber 7 and the longitudinal axis of the centrifugal separator are disposed coaxially to one another. Plate-shaped electrodes 9 are arranged distributed over the inner circumference of the collecting chamber 7 which have a shape corresponding to the casing interior surface 10. Their distance to the casing interior surface 10, respectively, to the inner circumference corresponds to the average diameter $d_\phi$ of the soot particles. The electrodes 9 are connected with the positive terminal of a d.c. voltage source while the collecting chamber 7 itself is connected with the negative terminal. The soot particles, moving along a circular path, now pass over from the centrifugal separator (not shown in FIG. 1) into the soot particle collecting chamber 7, are urged thereat by reason of the centrifugal forces acting on the same in the direction of the casing interior surface 10 of the collecting chamber (arrows 11) and are thus fed into the intermediate spaces 13 between the electrodes 9 and the casing interior surface 10. In order to be able to catch as many soot particles as possible, the electrodes 9 are angularly bent off toward the interior of the collecting chamber 7 on their side facing the flow, so that of which the soot particles can be received funnel-like. While passing through the intermediate spaces 13, the soot particles cause a short circuit between the electrodes 9 and the casing interior surface 10 which finally leads to their burning off.

Individual wires extending over the width of the collecting chamber, i.e., perpendicularly to the plane of the drawing of FIG. 1 and disposed at a close distance to one another may also be used as electrodes, whose spacing, to the casing surface then also correspond to the average diameter $d_\phi$ of the soot particles. A greater length of stay of the soot particles between the electrodes and the casing surface is attained therewith.

In the arrangement illustrated in FIG. 1, the distance of the electrodes 9 to the casing interior surface 10 need not necessarily correspond to the average diameter of the soot particles, it may also be selected larger so that it will lead not to the burning-off of individual soot particles, but to the burning-off of soot particle bridges which result from the fact that the soot particles adhering at the electrodes 9 by adhesion are connected by way of further soot particles with those soot particles that adhere at the casing interior surface 10, also by reason of adhesion forces.

Figure 2:
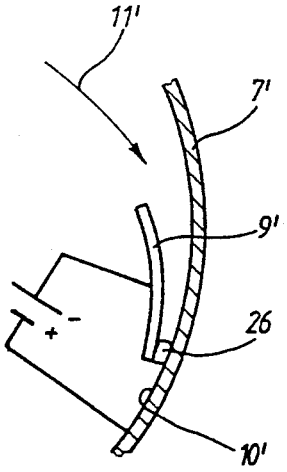
FIG. 2 is a partial cross-sectional view through a further embodiment of a soot particle collecting chamber in accordance with the present invention.

A further possibility of the arrangement of the electrodes in a soot particle collecting chamber is shown in FIG. 2. For the sake of simplicity, only a portion of an also cylindrical soot particle collecting chamber 7′ with an electrode 9′ is illustrated in this figure. The electrode 9′ is connected with the casing interior surface 10′ of the soot particle collecting chamber 7′ at the inner end of the side opposite the side facing the soot particles by way of an insulator 26. The insulator 26 extends over the entire width of the soot particle collecting chamber 7′. As also in FIG. 1, the electrodes 9′ are connected with one terminal and the collecting chamber 7′ with the other terminal of a voltage source.

The soot particles conveyed by the centrifugal force between the electrodes 9′ and the casing interior surface 10′ (arrow 11′) are dammed up in front of the insulator 26, are collected and burned off with a short-circuiting of the electrodes 9′ and the soot particle collecting chamber 7′.

FIG. 3 illustrates a soot particle collecting chamber 7″ connected to a centrifugal separator of customary construction (cyclone separator) as already described in connection with FIGS. 1 and 2, with the difference that in this embodiment the electrodes are constructed as ring electrodes 9″ concentrically surrounded by the soot particle collecting chamber 7′ and arranged adjacent one another at a small distance. It can be seen from FIG. 4, which represents a cross-sectional view of FIG. 3 taken along line IV—IV, that the ring electrodes 9″ themselves have a circular cross section. All of the ring electrodes 9″ are connected with the positive terminal of a d.c. voltage source and the soot particle collecting chamber 7″ itself with the negative terminal thereof. The burning-off of the soot particles thus takes place in this embodiment between the ring electrodes 9″ and the casing interior surface 10″ of the soot particle collecting chamber 7″.

The distance between the ring electrodes 9″ and the casing interior surface 10″ corresponds to the average diameter $d_\phi$ of a soot particle. However, it is also possible to select the spacing larger so that it will lead not to the burning-off of individual soot particles, but to the burning-off of soot particle bridges which result in that soot particles adhering at the ring electrodes 9″ by adhesion are connected by way of further soot particles with those soot particles which adhere to the casing interior surface 10″ also as a result of adhesion forces.

In a further construction according to the present invention, it is, of course, also possible to always connect one of two ring electrodes 9″ arranged adjacent one another with one terminal and the other with the opposite terminal of the d.c. voltage. The burning-off of the soot particles takes place in this case between the ring electrodes 9″. As regards the spacing of two ring electrodes 9″ with respect to one another, the same also applies in that case, namely that it corresponds to the average soot particle diameter $d_{100}$ or can also be greater.

FIG. 5 also illustrates a part of an exhaust gas line 1′ of a diesel internal combustion engine through which the exhaust gases flow in the direction of the arrow 14. A light source 15 is arranged in the exhaust gas line 1′ which emits ultraviolet light in the wavelength range of about 200 nm.

A rod-shaped electrode 16 is arranged downstream of this light source 15 which extends parallel to the flow direction and whose longitudinal axis coincides with the longitudinal center axis 17 of the exhaust gas line 1′. The rod electrode 16 is surrounded at a slight distance by a tubularly shaped burning-off electrode 18 which additionally has a mesh structure, i.e., is soot-particle-permeable. These two electrodes 16 and 18 are surrounded by an also tubularly shaped counter-electrode 19 whose diameter, however, is so dimensioned that it is arranged in direct proximity of the walls of the exhaust gas line 1'. A high voltage $U_H$ is applied between the rod electrode 16 and the counter-electrode 19 whereby the rod electrode 16 is charged negatively and the counter-electrode 19 positively.

In contrast thereto, a low voltage $U_N$ is applied between the rod electrode 16 and the burning-off electrode 18.

The soot particles 20 which arrive in the flow of the exhaust gases are now ionized in the area 21 by the radiation with the UV light and thus flow as positive charge carriers toward the electrodes 16, 18 and 19.

A portion of the soot particles 22 flows directly toward the rod electrode 16 (arrows 23) and is attracted by the same by reason of the negative charge thereof. The remaining soot particles 22 which flow between the burning-off electrode 18 and the counter-electrode 19, are repelled by the latter in the direction toward the burning-off electrode 18 by reason of a charge of similar polarity and as the burning-off electrode 18 is soot-particle-permeable, they deposit at the rod electrode 16 (arrows 24) attracted by the opposite charge. This will thus lead to a soot particle accumulation 25 at the rod electrode 16 (the soot particles 16, by reason of the negative potential of the rod electrode 16, are again discharged when coming in contact with same) and more particularly for such length of time until the soot particles come in contact with the burning-off electrode 18, as a result of which a short circuit will be established which brings the soot particles in the manner already described hereinabove to the reaction temperature required for their automatic burning-off. It is equally possible to arrange the burning-off electrode at a slight distance to the counter-electrode, to apply the low voltage $U_N$ between the counter-electrode and the burning-off electrode, and to reverse the polarity of the applied high voltage $U_H$ between the counter-electrode and the rod electrode. The positively charged soot particles are therewith repelled by the positively charged rod electrode and accumulate at the negatively charged counter-electrode where they finally burn off after establishing a short circuit.

The rod electrode, burning-off electrode and counter-electrode may also be constructed plate-shaped according to another embodiment of the present invention.

It is valid for all arrangements in accordance with the present invention that they may also be arranged in lines which conduct a partial exhaust gas stream enriched with separated soot particles that has been branched off previously from the main gas stream.

It is equally feasible with all arrangements to coat the electrical conductor elements thereof catalytically, as a result of which a soot particle burning-off is realizable already at a relatively low temperature level.

Both direct current as also alternating current voltages are suitable as voltage source.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An arrangement for removing soot particles from the exhaust gas stream of a diesel internal combustion engine, comprising soot particle collecting section means arranged in an exhaust gas line, conductor means in said soot particle collecting section means which are disposed at different potential, the soot particles being caught between said conductor means and producing thereat a closed electric circuit by means of which the soot particles are brought to the reaction temperature required for their automatic burning-off, a centrifugal separator means connected to the exhaust gas line, the soot particle collecting section means being constructed as soot particle collecting chamber means, said soot particle collecting chamber means being connected with the centrifugal separator means on the downstream side thereof and being constructed symmetrical with respect to the longitudinal axis of the centrifugal separator means, a number of electrode means arranged at a relatively small distance to the casing interior surface of the soot particle collecting chamber means, and the electrode means and the soot particle collecting chamber means being at different potential.

2. An arrangement according to claim 1, wherein a predetermined number of electrode means is arranged distributed over the circumference of the soot particle collecting chamber means, the spacing of the electrode means to the casing interior surface of the soot particle collecting chamber means being so selected that the electrode means and the interior surface are short-circuited by soot particles, the electrode means having a shape substantially corresponding to the inner surface of the soot particle collecting chamber means and the electrode means being operatively connected with one terminal of a d.c. voltage source and the soot particle collecting chamber means itself with the opposite terminal.

3. An arrangement according to claim 2, wherein the electrode means are angularly bent off toward the interior of the soot particle chamber means on their side facing the flow of the soot particles.

4. An arrangement according to claim 1, wherein a predetermined number of electrode means inclined toward the interior of the soot particle chamber means are arranged distributed over the inner circumference of the soot particle chamber means, the spacing of the electrode means to the interior surface of the soot particle chamber means being greater on the side facing the flow of the soot particles than on the opposite side thereof, the electrode means being operatively connected with the interior surface of the soot particle collecting chamber means on the opposite side by way of electrically nonconducting means, and the electrode means being operatively connected with one terminal and the soot particle collecting chamber means itself with the opposite terminal of a voltage source.

5. An arrangement according to claim 1, wherein the electrode means are constructed as ring electrodes arranged at a small distance adjacent one another and concentrically surrounded by the soot particle collecting chamber means.

6. An arrangement according to claim 5, wherein the ring electrodes have a substantially circular cross section.

7. An arrangement according to claim 5, wherein the ring electrodes are operatively connected with one terminal and the soot particle chamber means itself with the opposite terminal of a d.c. voltage source.

8. An arrangement according to claim 5, wherein always one of two adjacent ring electrodes is operatively connected with one terminal and the other ring electrode with the other opposite terminal of a d.c. voltage source.

9. An arrangement according to claim 6, wherein the ring electrodes are operatively connected with one terminal and the soot particle chamber means itself with the opposite terminal of a d.c. voltage source.

10. An arrangement according to claim 6, wherein always one of two adjacent ring electrodes is operatively connected with one terminal and the other ring electrode with the other opposite terminal of a d.c. voltage source.

11. An arrangement for removing soot particles from the exhaust gas stream of a diesel internal combustion engine, comprising soot particle collecting section means arranged in an exhaust gas line, conductor means in said soot particle collecting section means which are disposed at different potential, the soot particles being caught between said conductor means and producing thereat a closed electric circuit, by means of which the soot particles are brought to the reaction temperature required for their automatic burning-off, a centrifugal separator means connected to the exhaust gas line, the soot particle collecting section means being constructed as soot particle collecting chamber means, said soot particle collecting chamber means being connected with the centrifugal separator means on the downstream side thereof and being constructed symmetrical with respect to the longitudinal axis of the centrifugal separator means, a number of electrode means arranged at a relatively small distance to the casing interior surfaced of the soot particle collecting chamber means, and the electrode means among one another, being at different potential.

* * * * *